United States Patent [19]

Lautenschläger

[11] 4,297,763

[45] Nov. 3, 1981

[54] FURNITURE HINGE

[75] Inventor: Reinhard Lautenschläger, Reinheim, Fed. Rep. of Germany

[73] Assignee: Karl Lautenschlager KG, Reinheim, Fed. Rep. of Germany

[21] Appl. No.: 98,044

[22] Filed: Nov. 28, 1979

[30] Foreign Application Priority Data

Feb. 12, 1978 [DE] Fed. Rep. of Germany ..... 2852229

[51] Int. Cl.[3] ..... E05D 3/06; E05D 3/10; E05D 15/52; E05D 15/54

[52] U.S. Cl. ..... 16/164; 16/163; 403/119

[58] Field of Search ..... 16/163, 164, DIG. 29, 16/165, 166

[56] References Cited

U.S. PATENT DOCUMENTS

| | | | |
|---|---|---|---|
| 2,954,578 | 10/1960 | Nyquist | 16/164 |
| 3,605,173 | 9/1971 | Lautenschläger | 16/164 X |
| 4,112,543 | 9/1978 | Röck et al. | 16/164 X |
| 4,138,766 | 2/1979 | Röck et al. | 16/163 X |

FOREIGN PATENT DOCUMENTS

| | | | |
|---|---|---|---|
| 341909 | 3/1978 | Austria . | |
| 1250297 | 9/1967 | Fed. Rep. of Germany | 16/164 |
| 2613661 | 10/1977 | Fed. Rep. of Germany | 16/164 |
| 487324 | 3/1970 | Switzerland . | |

*Primary Examiner*—Wayne L. Shedd

[57] ABSTRACT

A hinge for the pivotable linking of a door leaf or lid to the carcass of a furniture piece having a door-related part attachable to the door leaf or lid and a supporting-wall-related part, which parts are pivotingly joined together in the manner of a four-joint hinge by two hinge links pivotingly attached to the door-related part on the one hand to the supporting-wall-related part on the other hand. The outer hinge link farther from the supporting wall is linked on the supporting wall side to a pivot piece pivotingly linked to the supporting wall-related part. The pivot piece is coupled operatively to the inner hinge link nearer the supporting wall such that the pivot axis of the outer hinge link on the supporting wall end has in the hinge-open position a minimum distance and the the hinge-closed position a maximum distance from the pivot axis of the inner hinge link at the supporting wall end thereof.

6 Claims, 6 Drawing Figures

FURNITURE HINGE

BACKGROUND

The invention relates to a hinge for the pivoting of a door leaf or lid on the carcass of a piece of furniture having a door-related part attachable to the door leaf or lid, and a supporting wall-related part attachable to the supporting wall of the carcass, the two being joined together by two hinge links articulated each to the door-related part at one end and to the supporting wall-related part at the other in the manner of a four-pivot hinge.

Such four-pivot hinges have been used increasingly in recent years on cabinets in which the hinges attaching the doors to the cabinet carcass are to be invisible in the closed state, door opening angles of up to about 110° being achievable with these hinges, while for larger opening angles of up to 180° more complex and hence more expensive and also substantially bulkier articulated hinges are required in the form of what are known as crosslink hinges. In cases in which slides concealed by the doors in the cabinet carcass, such as drawers or pull-out cutting boards or work leaves, which are to have a width corresponding to the free internal dimension of the cabinet carcass, four-pivot hinges cannot be used, because the inside edges of the door leaves mounted thereby are still within the free opening of the cabinet carcass when they are open, on account of the cinematics of the four-pivot hinges, so that drawers and the like would collide with the inner edges of the doors. In such cases it would therefore be necessary to use the above-mentioned more expensive cross-link hinges, which on account of their size are also less satisfactory in appearance, even if door opening angles of 110° or less were required.

THE INVENTION

Accordingly, it is the object of the invention to improve the known four-pivot hinges such that, without increasing their dimensions, they will be suitable for the mounting of doors or lids on the cabinet carcass whenever drawers or pull-out shelves or boards of a width corresponding to the clear interior width of the carcass are to be installed therein.

Setting out from a hinge of the kind mentioned above, this object is achieved in accordance with the invention in that the outer hinge link, i.e., the hinge link farther out from the supporting wall is pivotingly attached at its supporting-wall end to a pivot piece pivotingly attached in turn to the supporting-wall related hinge part, and that the pivot piece is operatively coupled to the inner hinge link, i.e., the hinge link nearer to the supporting wall, such that the outer hinge link pivot axis on the supporting wall side is at a certain minimum distance from the inner hinge link pivot axis in the open position of the hinge, and in the closed position thereof it is at a maximum distance therefrom. In the linkage of the known four-pivot hinge, therefore, an additional member to be referred to hereinafter as the "pivot piece" is installed, which imparts to the door-related hinge part during the opening movement an additional component of movement which suffices to position the inner edge of the door leaf laterally aside from the clear interior of the cabinet carcass when it is in the fully open position. The incorporation of an additional link producing the additional component of movement between the outer hinge link and the supporting arm, however, would have the effect of providing the articulation of the hinge with two degrees of freedom unless further measures were taken, i.e., the hinge would no longer have any set pattern of opening movements. Due to the operative coupling of the additional pivot piece to the inner hinge link, however, the geometry of the hinge is again reduced to an articulation having one degree of freedom, so that the hinge of the invention will perform a specific opening movement, which then satisfies the requirement with regard to the position of the inner edges of the door leaf.

If the supporting wall-related part of the hinge of the invention has the form of an elongated supporting arm of approximately U-shaped cross section with its sidewalls projecting towards the supporting wall, which is conventional in four-pivot hinges, the design is preferably made such that the pivot piece is pivoted on the supporting arm about a pivot axis parallel to the pivot axes of the hinge links on the supporting arm side and offset towards the interior of the carcass, and that the inner hinge link, which is articulated directly to the supporting arm, has a prolongation extending beyond its pivot axis on the supporting arm toward the interior of the supporting arm, the free end of the prolongation being coupled to a projection of the pivot piece that is situated also within the supporting arm, for rotation and simultaneous longitudinal displacement in the manner of a toggle joint.

The prolongation of the inner hinge link, in a preferred embodiment of the invention, is formed by two cheeks which are bent around and extend past the pivot axis at the supporting arm end, between which cheeks a pin disposed parallel to the pivot axis is provided, which engages an elongated, slot-like recess in the projection of the pivot piece.

In order that the hinges may have an integrated appearance when the door is open, the articulation of the pivot piece on the supporting arm is such that the portion of the supporting arm whereby the sidewalls of the arm are joined is cut away, and that the pivot is fitted between the sidewalls and is pivotingly mounted on the latter by a pin passing through its inner end and through the sidewalls.

At the same time the pivot piece then has in its portion between the sidewalls of the supporting arm approximately the width of the clear inside distance between the same supporting arm sidewalls, and its portions which protrude from the sidewalls when the hinge is in the open position are preferably widened laterally by approximately the thickness of the sidewalls.

It is furthermore recommendable that the boundaries seen in the side view of the area of the pivot piece protruding from the side portions be made to merge with the adjacent boundaries of the supporting arm. By these measures it is brought about that the pivot piece when in the open position so matches the shape of the supporting arm that the supporting arm and the pivot piece appear to be a single, continuous component.

The invention will be further explained in the description of an embodiment that follows, in conjunction with the drawing, wherein.

Figure 1:
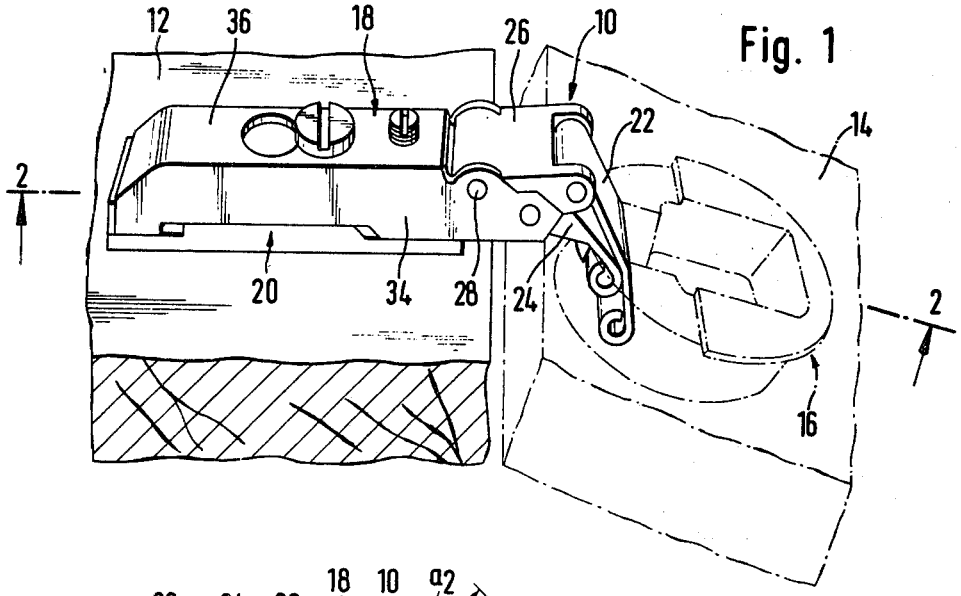
FIG. 1 is a perspective view of a hinge constructed in the manner of the invention, which is represented in the open state.
Figure 2:
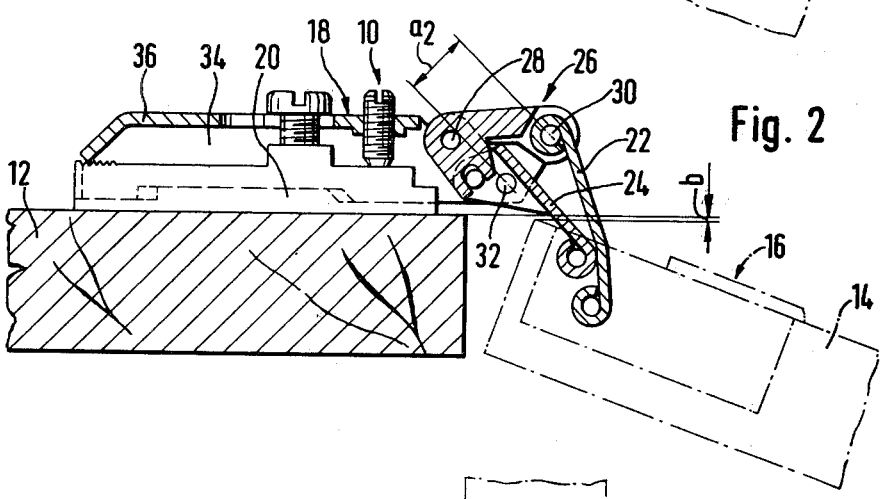
FIG. 2 is a cross-sectional view as seen in the direction of the arrows 2—2 of FIG. 1.
Figure 3:
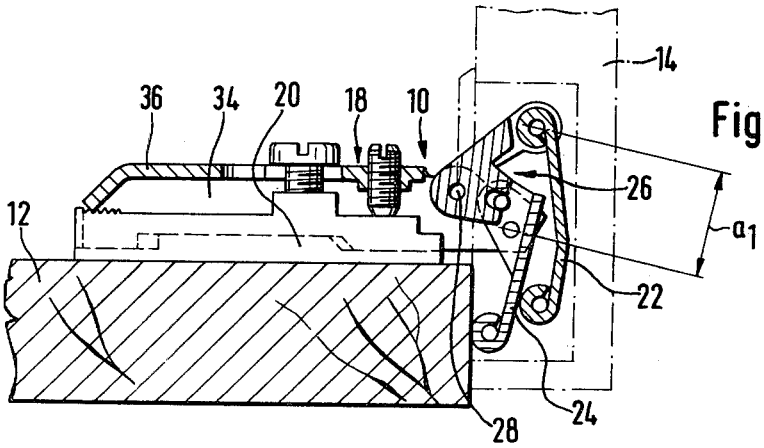
FIG. 3 is a cross-sectional view as seen in the same manner as in FIGS. 1 and 2, but with the hinge represented in the closed position.

In FIGS. 1 to 3 the hinge of the invention, generally designated at 10, is represented on the supporting wall 12 of a piece of furniture, the door-related part of the hinge, in the form of a cup 16 fastened in a mortise in the door leaf 14, and the corresponding door leaf itself, being indicated only diagrammatically by broken lines. The supporting wall-related part of the hinge, in the form of an elongated supporting arm 18, is in turn mounted adjustably in the conventional manner on a mounting plate fastened to the supporting wall 12. The supporting arm 18 of hinge 10 is coupled to the door-related part of the hinge by two hinge links 22 and 24, the inner link 24, i.e., the one nearer the supporting wall 12, being attached directly to the end of supporting arm 18 projecting beyond the edge of the supporting wall, and the outer link 22, i.e., the one farther from the supporting wall, being attached to a pivot piece 26 which in turn is pivoted on the supporting arm 18. The pivot axes of the hinge links on the door side and supporting wall side all are disposed parallel to one another and to the imaginary pivot axis of the hinge which shifts in space. The mounting plate 20 is mounted on the supporting wall 12, the cup 16 is mounted on the door leaf 14 and the supporting arm 18 is adjustably mounted on the mounting plate 20 in ways commonly seen in the known four-pivot hinges, so that they need not be further explained in the present situation.

New and essential to the invention, however, is the indirect articulation of the supporting-wall end of the outer hinge link 22 on the pivot piece 26 in the supporting arm 18. The hinge thus becomes virtually a five-pivot hinge, since the pivot piece 26 is in turn pivoted on the supporting arm 18. A five-member linkage having links that are merely pivotingly coupled would have two degrees of freedom, however, which is not acceptable in a furniture hinge in which a defined door opening and closing movement is required, because such a defined movement is possible only in linkages having one degree of freedom. The pivot piece 26, therefore, is operatively coupled to the inner hinge link 24 in the manner yet to be explained below, whereby the linkage of the hinge 10 is reduced in the necessary manner to one degree of freedom. The pivot piece 26 virtually replaces the upwardly and forwardly bent front portion of the supporting arm of the conventional four-pivot hinges, on which otherwise the supporting-wall end of the outer hinge link is pivoted. In the hinge-closed position (FIG. 3) the pivot piece 26 therefore also has a position which corresponds to this bent end of the supporting arm. But in order to set the door leaf 14 completely outside of the clear interior profile of the cabinet carcass and forward of the supporting wall when it is in the open state (FIGS. 1 and 2), the normal bent hinge part is, so to speak, separated from the supporting arm and is instead pivotingly mounted at 28 on the supporting arm such that the pivot axis 30 of the outer hinge link 22, in the hinge-open position, will be moved in the desired direction towards the supporting wall, i.e., closer to the pivot axis 32 of the inner hinge link, which is fixed on the supporting arm. That is to say, the distance between the pivot axes 30 and 32 of the hinge links 22 and 24 is controlled by the pivot piece 26 such that the distance $a_1$ obtaining in the closed position is shortened during the opening movement to the distance $a_2$, the component of movement directed at right angles to the flat side of the supporting wall being transferred to the outer hinge link 22 and by the latter to the door-related hinge part 16. In this manner the door-side pivot axis of hinge part 16 is displaced in this direction, and the result is that the inside edge of the open door leaf 14 is additionally displaced by the amount b (FIG. 2) away from the inside edge of the supporting wall 12. The door leaf 14, therefore, in the open position, no longer extends into the clear interior profile of the carcass, and drawers or slides of any kind can be installed in the full width of the clear interior of the cabinet.

Figure 4:
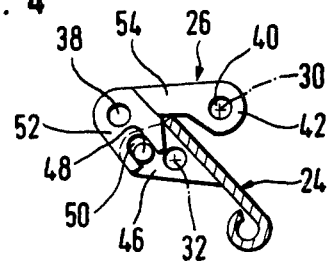
FIG. 4 is a side elevational view, partially in cross section, of the pivot piece and of the inner link of the hinge of FIGS. 1 to 3.
Figure 5:
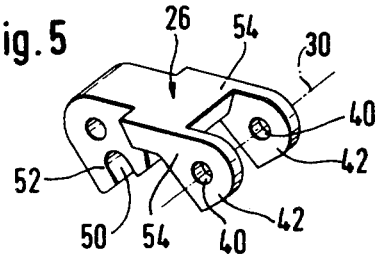
FIG. 5 is a perspective view of the pivot piece.
Figure 6:
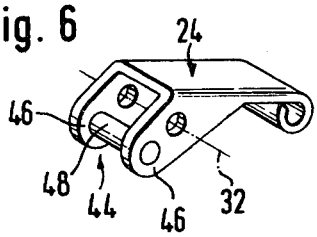
FIG. 6 is a perspective view of the inner link of the hinge represented in FIGS. 1 to 3.

The articulation of the pivot piece 26 on the supporting arm is designed such that, as stated, the bent portion of a conventional supporting arm is eliminated, so that in the forward end area virtually only the sidewalls 34 of the supporting arm 18, which in its rearward portion is of U-shaped cross section, remain, i.e., the portion 36 of the supporting arm which unites the side portions is removed from the forward end. The rearward end of the pivot piece 26 is inserted into the space bertween the remaining sidewalls 34, and is pivoted on a pin 28 passing through the sidewalls 34 and a bore 38 (FIGS. 4 and 5) in its rearward end. The supporting-wall end of the outer hinge link 22 is pivoted on a pin held in bores 40 in projections 42 of pivot piece 26. The central axis of bores 40 thus coincides with the pivot axis 30 of the hinge link 22.

The pivoting movement of the pivot piece 26 during the opening and closing movement is brought about by a coupling with the inner hinge link 24. For this purpose the inner hinge link 24 has a prolongation 44 extending beyond the pivot axis 32 at its supporting-arm end into the interior of the supporting arm, this prolongation being formed by two cheeks 46 bent down laterally from the link, and a pin 48 extending between these cheeks parallel to the pivot axis 32. This pin 48 engages an elongated, slot-like recess 50 in a projectin 52 extending integrally from the pivot piece 26 beneath the bore 38. The engagement of pin 48 in the slot-like recess 50 in the hinge-open position is shown in FIG. 2 and separately in FIG. 4, and in FIG. 3 this engagement is shown in the hinge-closed position. It can be seen that what is involved is a coupling in the manner of a toggle, since the pin 48 both shifts and rotates in the recess 50.

In the portion 54 which is extended forward and upward from the supporting arm cheeks 34 when the hinge is in the open position, the pivot piece is broadened to correspond approximately to the dimension measured across the outside surfaces of the sidewalls 34. In the hinge-open position, the supporting arm 18 including the pivot piece 26 therefore presents an integral appearance, which is contributed to by the fact that the upper surface of the pivot piece 26 is then flush with the surface of portion 36 of the supporting arm and the lower, slanting edges of its forward projections 42 abut against the corresponding front edges of the sidewalls 34. The wider portions 54, however, in addition to improving appearance, also serve as abutments to limit the downward pivoting of the pivot piece 26 to the amount needed for the full open position. Corresponding abutments for the closed position, on the other hand, are unnecessary, because in that position the outer hinge link 22 engages the bottom of the door-related hinge part 16 in the form of a cup.

I claim:

1. A hinge for pivotably linking a door leaf or lid to a carcass of a furniture piece, said hinge having a door-related part attachable to the door leaf or lid, and a supporting-wall-related part attachable to said carcass, first and second hinge links both pivotingly attached to the door-related part and pivotingly joining said parts together in the manner of a four-joint hinge so that the same is movable from a hinge-open to a hinge-closed position and vice versa, said first link being farther from the supporting wall-related part than said second link and being linked to a pivot piece so as to be pivotable about a first pivot axis, said pivot piece being pivotingly linked to the supporting wall-related part so as to be pivotable about a second pivot axis, said second hinge link being pivotably linked to said supporting wall-related part at a third pivot axis and said pivot piece being coupled operatively to said second hinge link such that said first pivot axis of said first hinge link has in said hinge-open position a minimum distance and in said hinge-closed position a maximum distance from said third pivot axis.

2. A hinge according to claim 1, in which said supporting-wall-related part has the form of an elongated supporting arm of approximately U-shaped cross-section, with free ends of the legs of the U pointing toward the supporting wall to which it is to be connected, wherein said second pivot axis is disposed parallel to said first and third pivot axes and offset towards said supporting arm, said second hinge link having a prolongation projecting beyond said third pivot axis into the supporting arm interior and having a free end, said pivot piece having a projection coupled to said free end, said projection lying within said U-shaped cross-section of said supporting arm, so as to be rotatable and longitudinally displaceable in the manner of a slide junction.

3. A hinge according to claim 2, wherein said prolongation is formed by two lateral, overfolded cheeks prolonged beyond said third pivot axis, a pin between said cheeks disposed parallel to said third pivot axis and engaging in an elongated, slot-like recess in said projection of said pivot piece.

4. A hinge according to claim 2 or 3, wherein said U-shaped supporting arm has a crosswall joining said legs, said crosswall having a cut-away end portion facing said door-related part, said pivot piece extending between said legs at said cut-away portion, and a pin pivotingly mounting said pivot piece to said arm passing through said legs and said piece.

5. A hinge according to claim 4, wherein said pivot piece in its areas lying between said legs has approximately the width of the clear inside distance of the supporting arm legs from one another, and that areas of said piece projecting from the legs in said hinge-open position are widened laterally approximately by the amount of the thickness of the legs.

6. A hinge according to claim 5, wherein the profile, seen in the side view, of the area of said pivot piece protruding from said legs merges in the hinge-open position with the adjoining confines of the supporting arm.

* * * * *

UNITED STATES PATENT AND TRADEMARK OFFICE

CERTIFICATE OF CORRECTION

PATENT NO. : 4,297,763

DATED : November 3, 1981

INVENTOR(S) : Reinhard Lautenschlager

It is certified that error appears in the above-identified patent and that said Letters Patent are hereby corrected as shown below:

On the title page, Item [30] should read:

[30] Foreign Application Priority Data

December 2, 1978 [DE] Fed. Rep. of Germany ... 2852229

Signed and Sealed this

*Twenty-third* Day of *March 1982*

[SEAL]

*Attest:*

GERALD J. MOSSINGHOFF

*Attesting Officer*

*Commissioner of Patents and Trademarks*